US007955181B2

(12) United States Patent
Drollinger et al.

(10) Patent No.: US 7,955,181 B2
(45) Date of Patent: Jun. 7, 2011

(54) DEVICE FOR PRACTICING A SEQUENCE OF MOVEMENT IN THE GOLF SWING

(76) Inventors: Andrea Drollinger, Engelsbrand (DE); Frank Drollinger, Engelsbrand (DE)

( * ) Notice: Subject to any disclaimer, the term of this patent is extended or adjusted under 35 U.S.C. 154(b) by 20 days.

(21) Appl. No.: 12/312,828

(22) PCT Filed: Dec. 3, 2007

(86) PCT No.: PCT/EP2007/010494

§ 371 (c)(1),
(2), (4) Date: May 28, 2009

(87) PCT Pub. No.: WO2008/064919

PCT Pub. Date: Jun. 5, 2008

(65) Prior Publication Data

US 2010/0062871 A1 Mar. 11, 2010

(30) Foreign Application Priority Data

Dec. 1, 2006 (DE) ..... 10 2006 057 722

(51) Int. Cl.
*A63B 69/36* (2006.01)

(52) U.S. Cl. ..... 473/272; 473/279

(58) Field of Classification Search ..... 473/218, 473/266, 269, 270, 271, 272, 278, 279
See application file for complete search history.

(56) References Cited

U.S. PATENT DOCUMENTS

| | | | | |
|---|---|---|---|---|
| 2,189,613 | A | 2/1940 | Paulsen | |
| 2,879,996 | A * | 3/1959 | Lederer | 473/279 |
| 4,657,258 | A | 4/1987 | Melov et al. | |
| 6,723,004 | B1 * | 4/2004 | Florian | 473/270 |
| 7,125,350 | B1 * | 10/2006 | Reason-Kerkhoff | 473/452 |
| 2004/0082399 | A1 | 4/2004 | Shioda | |
| 2005/0153787 | A1 | 7/2005 | Kim | |

* cited by examiner

*Primary Examiner* — Nini Legesse

(57) ABSTRACT

Device for practicing a sequence of movement in the golf swing, includes a base, and a first support, that is mounted on the base in a manner such that it can pivot about a first vertical axis and is intended for a golf player to place a first foot onto the first support which has a first supporting part for supporting the front part of the foot and a second supporting part that can be pivoted about a horizontal axis and is intended for supporting the heel of the first foot, a guide device is provided which is arranged on the base in a manner such that it at least partially surrounds the first vertical axis and which exhibits a curved design which rises from a lowermost point and which supports the second supporting part, and a second support is provided for the golf player to place his second foot on.

34 Claims, 16 Drawing Sheets

DEVICE FOR PRACTICING A SEQUENCE OF MOVEMENT IN THE GOLF SWING

The present invention relates to a device for practicing a sequence of movement in the golf swing.

It is normal practice that a golfer practicing a golf swing, especially the tee-off, will be observed, judged and instructed by a golf trainer. However, when the golfer practices all for himself, faults may occur in the sequence of movement without the golfer getting aware of them. The golfer gets used to the faulty sequence of movement and will have difficulty later to cure the mistake.

The present invention has for its object to provide the golfer with a means that will help habituating him to a better sequence of movement in practicing the golf swing.

SUMMARY OF THE INVENTION

That object is achieved by a device having the features defined in Claim 1. Advantageous further developments of the invention are the subject-matter of the subclaims. The device according to the invention for practicing the golf swing comprises a base and two supports mounted on the base and intended for the golf player to place his feet on. A first support intended for a first foot of a golfer is mounted on the base in a manner such that it can pivot about a first vertical axis. The first support has a first supporting part for supporting the front part of the foot and a second supporting part for supporting the heel of the first foot. The second supporting part can be pivoted about a horizontal axis, being guided and supported by a guide device which is arranged on the base in a manner such that it at least partially surrounds the first vertical axis. The guide device has a curved design, surrounding the first vertical axis, and rises from a lowermost point. Further, the device according to the invention comprises a second support which is intended for the golf player to place his second foot on. While the second support may consist of the base as such, or may be part of the base, it preferably is a part separate from the base.

For practicing the sequence of movement for the tee-off, the golfer places his feet on the two supports and either simulates a tee-off without a golf club or practices the tee-off with a golf ball. In doing so, he is expected to swing the one of his hips, that points away from the target of the ball, in the direction of that target. Connected with this movement is a rotation of his foot, which points away from the target, which rotation is facilitated and supported by the support mounted on the base. The pivoting movement of the first support simultaneously lifts the second supporting part of the support, supporting the heel of the foot that points away from the target, as the second supporting part moves along the guide device, the latter being designed to rise from a lowermost point. The arrangement of the device is selected so that the second supporting part is supported on the lowermost point of the guide device when the golfer is in its starting or initial position from which he starts the golf swing. In that starting or initial position, the two supporting parts should have substantially the same height. During the follow-through movement, the second supporting part, being guided by the guide device, necessarily raises the heel placed on it.

This provides substantial advantages:

- The device supports the golfer in arriving at a sequence of movement that is favorable for a tee-off.
- The pivoting first support makes it easier for the golfer to turn his hip, which points away from the target, toward the target during the follow-through movement.

- The second supporting part, which rises during the pivoting movement of the first support, necessarily raises the heel of the foot resting on it.
- The design of the guide device can be suitably configured to predefine an ergonomically favorable sequence of movement, from the foot to the hip of the leg that points away from the target.
- The sequence of movement for the leg that points away from the target, being predefined by the contour of the guide device and remaining always the same, helps the golfer to habituate himself to an invariable sequence of movement which makes the golfer's playing strength more stable.
- The device is suited for both simulated tee-offs practiced with or without a golf club, and also for tee-offs practiced with a ball. Especially, it allows the golfer to practice and improve the rotary push-off by the foot that faces away of the target, which is to accompany the follow-through movement and which is so important for an accurate and long tee-off.
- The device trains and builds up the muscles that participate in the tee-off and, especially, in the rotary push-off.
- The device is suited for use on the driving range of a golf court and also as a practicing device in sports studios, hotel fitness rooms and for use in the golfer's own home.

The second support, on which the golfer is to place his second foot, i.e. the one facing the target, is mounted on the base in a manner such that, preferably, it can pivot about a vertical axis. This helps relieve and spare the joints and ligaments of a golfer in practicing and furthers a smooth easy-going sequence of movement.

Preferably, the two supports have a mechanically defined initial position to which they will return preferably automatically after having been swung out of their initial position. In their initial position, the two supports should be arranged in a way corresponding to the golfer's natural training position. In the natural standing position, the feet normally enclose between them an angle of between 0° and 30°. The same is preferred for the initial position of the two supports.

For returning the supports to their initial positions, each support preferably coacts with a spring which is tensioned when the support is swung out of its initial position so that its tension tends to pull the support back to its initial position. The force required for tensioning the spring must be applied by the practicing golfer, and this further contributes to improving the training success and the buildup of the muscles.

The first axis, about which the first support can be pivoted, preferably is arranged below the first supporting part of the first support. This is favorable under ergonomic aspects.

For ensuring the pivotable mounting and support of the first support, there is preferably provided an arrangement consisting of a hollow or a solid pin and a sleeve in which the pin is received. The arrangement is such that either the pin is mounted on the base and the sleeve is mounted on the bottom of the first support, especially on the bottom of the first supporting part of the first support, or the sleeve is mounted on the base and the pin is mounted on the bottom of the first support. The pin and the sleeve engage each other thereby rendering possible not only the desired pivoting movement but also transmission of the golfer's weight to the base of the device.

A momentum tending to return the first support to its initial position can be produced, for example, by arranging between the support and the base, or between the sleeve and the pin, a torsion spring that will be tensioned when the support is swung out of its initial position. Another, especially advantageous possibility consists in providing a slotted link in the pin which is engaged by a bolt arranged in the sleeve, or by providing a slotted link in the sleeve which is engaged by a bolt provided on the pin. The slotted link is given a slope such that the first supporting part of the first support will move in downward direction when being pivoted out of its initial position. The pin then moves downward in the sleeve. When a helical spring is provided in the sleeve, which is engaged and compressed by the pin as it moves down in the sleeve, then the helical spring will be compressed when the first support is pivoted out of its initial position. The restoring force building up during that movement is capable of restoring the support to its initial position when the golfer yields to the restoring force, at the end of the golf swing.

This further development of the invention can be realized with particular advantage when the pin is designed as a hollow pin whose inner space can be used for accommodating the helical spring so that a longer helical spring with longer spring excursion can be used. Another advantage of that embodiment of the invention lies in the fact that the first supporting part is moved down, against the restoring force of the helical spring, as the first support is pivoted out of its initial position. This contributes toward raising the second supporting part relative to the first supporting part so that the raising task does not have to be performed by the guide device alone. At the same time, the rotary push-off, which is to accompany the follow-through movement and which is effected by the golfer by that foot which points away from the target, is suited to reinforce, or even to initiate, the desired rotary movement of the golfer's body as a result of the downwardly acting push-off force of the foot. This again furthers the raising movement of the second supporting part of the pivotable first support. The slotted link that combines the pivoting movement of the first support and its downward movement during the rotary push-off is of particular importance for the training success gained with the aid of the device.

When the golfer pushes himself off during the follow-through movement using that foot which points away from the target, then he does this using the front of his foot. Accordingly, it is an advantage if the pin and the sleeve, which allow the first support to rotate, are arranged below the first supporting part, which supports the front of the golfer's foot, so that the push-off force is transferred as directly as possible to the arrangement consisting of the slotted link and the bolt by which it is engaged, in order to initiate and/or reinforce the rotary movement.

The slope of the slotted link preferably is between 0.01 cm per degree up to 0.025 cm per degree of the pivot angle, especially approximately 0.02 cm per degree of the pivot angle of the first support. This provides for a lowering movement of the first supporting part by up to 2 cm in the course of a golf swing.

The spring, which opposes resistance to the downward movement of the pin into the sleeve, may also be arranged on the outside, in which case it surrounds the pin and is engaged by the forward end of the sleeve. When the sleeve is mounted on the bottom of the first support, then the spring is compressed between the sleeve and the base of the device. When the sleeve is mounted on the base, then the spring is compressed between the sleeve and the bottom of the first supporting part of the first support. An inner spring is, however, preferred over an outer spring.

The inner spring need not necessarily be a helical spring; instead of a helical spring, a stack of cup springs may be provided as well.

Preferably, the first support coacts with two slotted links with oppositely directed slopes, and the bolt engages either the one slotted link or the other slotted link. This provides the advantage that the swinging direction of the support can be varied. And this is necessary when one and the same device is to be used by right-handed and by left-handed individuals.

Preferably, a spring—the second spring—is provided also for the second support; that spring tends to return the second support to its initial position after it has been swung out of its initial position. The second spring preferably is a torsion spring that surrounds the second axis about which the second support can be pivoted. However, the second spring may also be a helical spring, arranged in the same way as the helical spring which is preferred for the first support.

For pivotally mounting the second support on the base there is provided, just as in the case of the first support, an arrangement consisting of a solid or a hollow pin and a sleeve adapted to receive the pin. Again, a slotted link is provided either in the pin or in the sleeve, for being engaged by a bolt provided in the sleeve or in the pin. The slotted link defines a defined position of the second support and limits its pivoting movement. While the slotted link associated with the first support is to allow a pivot angle of 90° for swinging the support out of its initial position, the pivoting angle of the second support, allowed by the second slotted link, preferably is much smaller and, preferably, not over 30°. The slotted link for the second support may be horizontal, or may be given a slope so that the second support is pushed down a little as it is swung out of its initial position. This provides the advantage that the restoring force of the second spring, coacting with the second support, can be gained not only from torsion but also from compression of a helical spring and that the foot placed on the second support is permitted to follow the downward movement of the front part of the foot over a certain distance in the course of the golf swing.

The slope of the second slotted link, coacting with the second support, preferably is 0.005 cm per degree, up to 0.015 cm per degree, especially 0.01 cm per degree of the pivot angle of the second support.

The base of the device preferably is provided with holders for the two supports that are arranged at different spacings. This provides the advantage that the spacing of the supports can be adapted to different persons with their respective natural standing positions. Preferably, the holders are bores adapted to receive the pin, for example, about which the respective support can be pivoted. To vary the spacing of the supports it is then only necessary to change the bore for one of the supports, preferably the second support.

Preferably, the base of the device is provided with holders also for the guide device. The holders for the guide device and for the two supports preferably are designed and arranged so that the position of the two supports and the guide device can be changed, from a given arrangement to a mirrored arrangement. This is advantageous to make one and the same device suited for use by right-handed and also by left-handed persons.

The base of the device preferably is a horizontal plate on which the two supports and the guide device for the first support are mounted. To save weight, the plate may be provided with recesses.

The first supporting part and the second supporting part of the first support may be connected one with the other. Preferably, the second supporting part is hinged directly to the second supporting part. This is the simplest way of procuring that, for raising the heel, the first supporting part can be pivoted in upward direction from a horizontal initial position, in which it is in alignment with the first supporting part.

A roller provided on the first support, preferably on its second supporting part, is adapted to roll on the guide device. This ensures a low-friction guiding effect.

In order to permit tee-offs to be not only simulated, but also effectively carried out on the device, the device preferably is provided with a tee-off surface on which the golf ball can be placed in a suitable tee-off position. Alternatively, or additionally, the device may also be provided with a positioning tee on which the golf ball can be placed in a suitable tee-off position. The tee used need not necessarily be a rigid tee, but may also be a flexible tee, for example one equipped with an upright piece of an elastomeric tube of the kind normally used on tee mats on the driving range.

BRIEF DESCRIPTION OF THE DRAWINGS

Certain embodiments of the invention are illustrated diagrammatically in the attached drawings.

DETAILED DESCRIPTION

Figure 1:
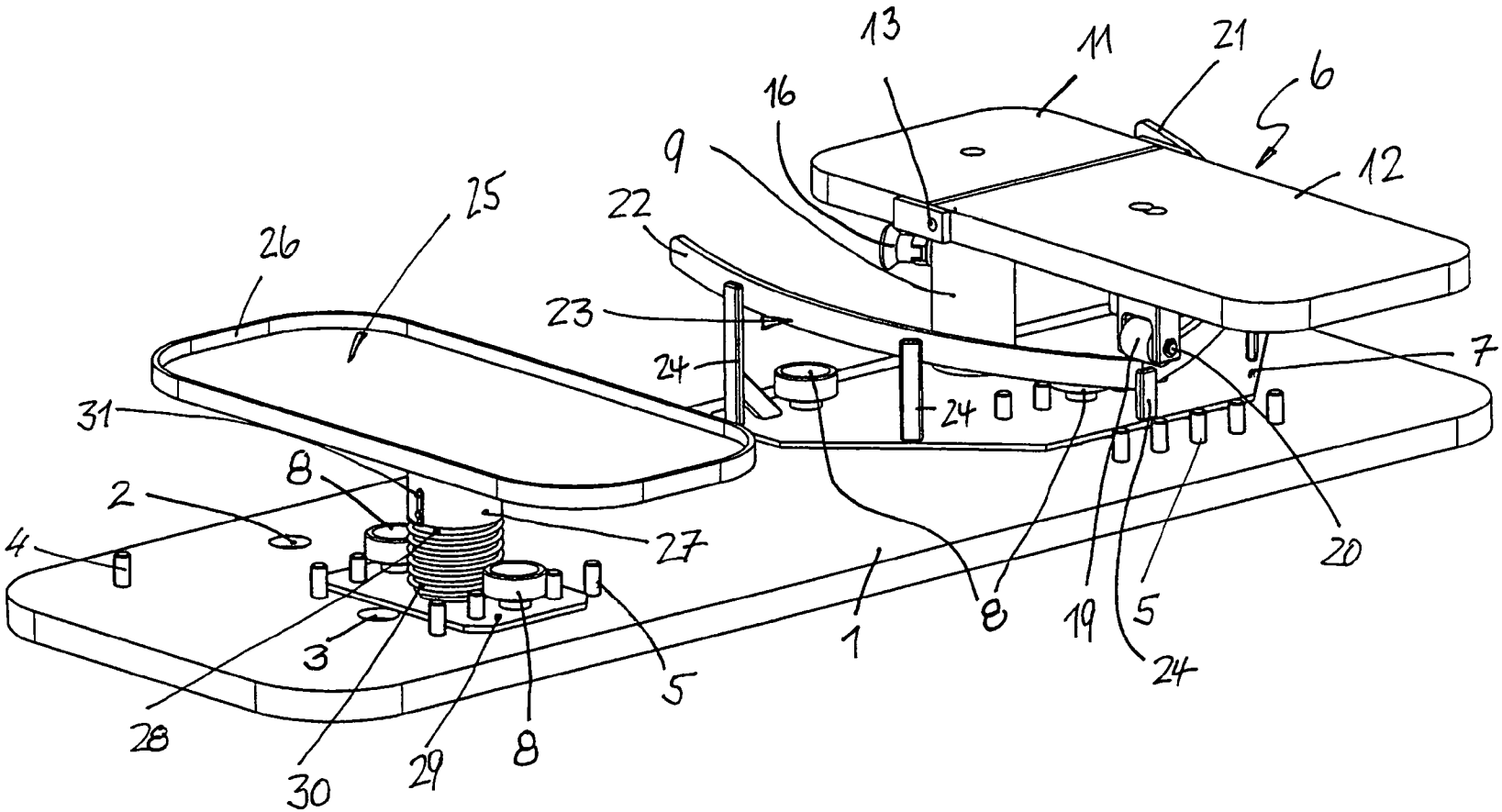
FIG. 1 shows an oblique view of a device according to the invention, with both supports in their initial position.
Figure 2:
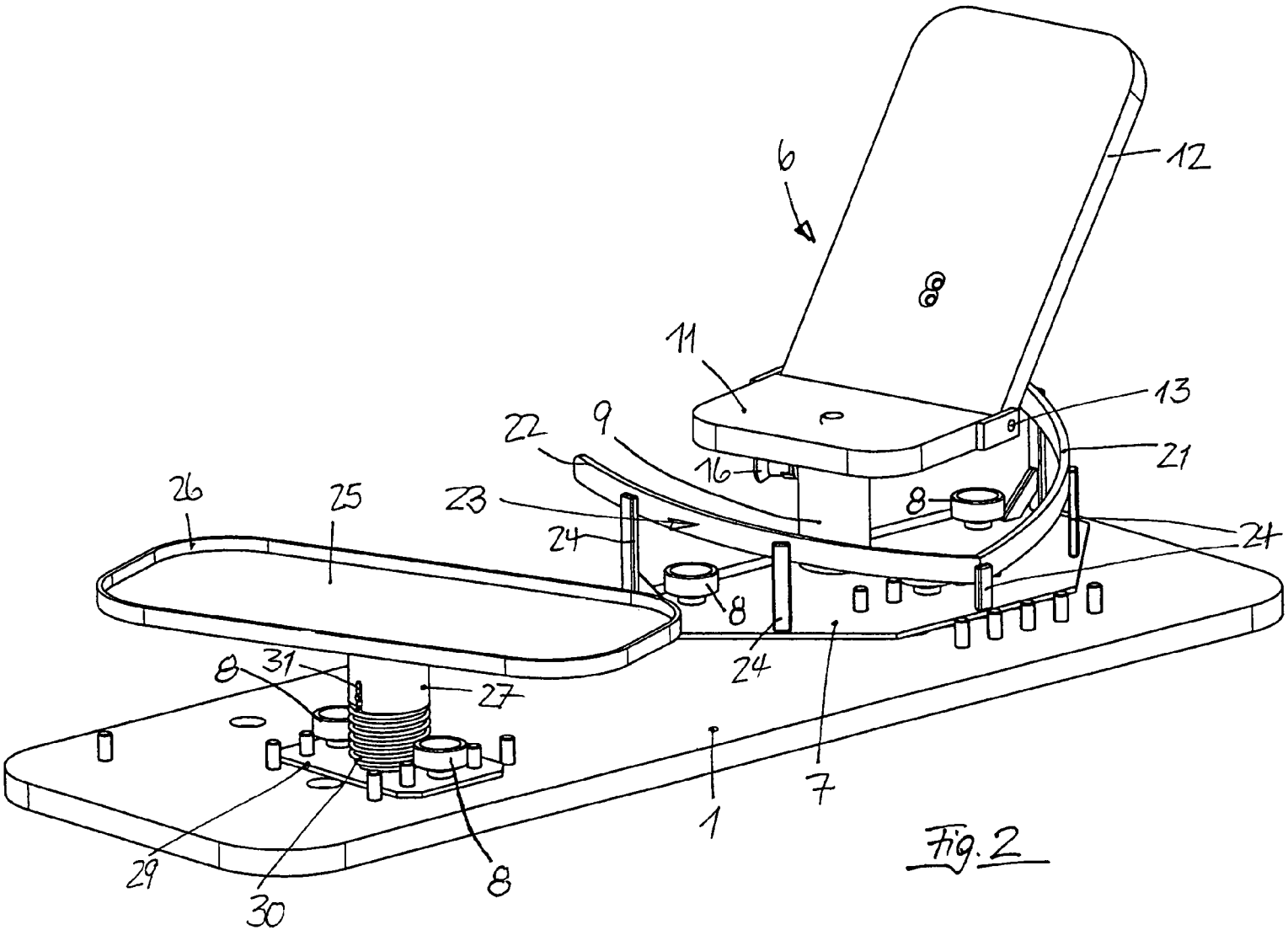
FIG. 2 shows a first oblique view of the device, with both supports pivoted out of their initial positions.
Figure 3:
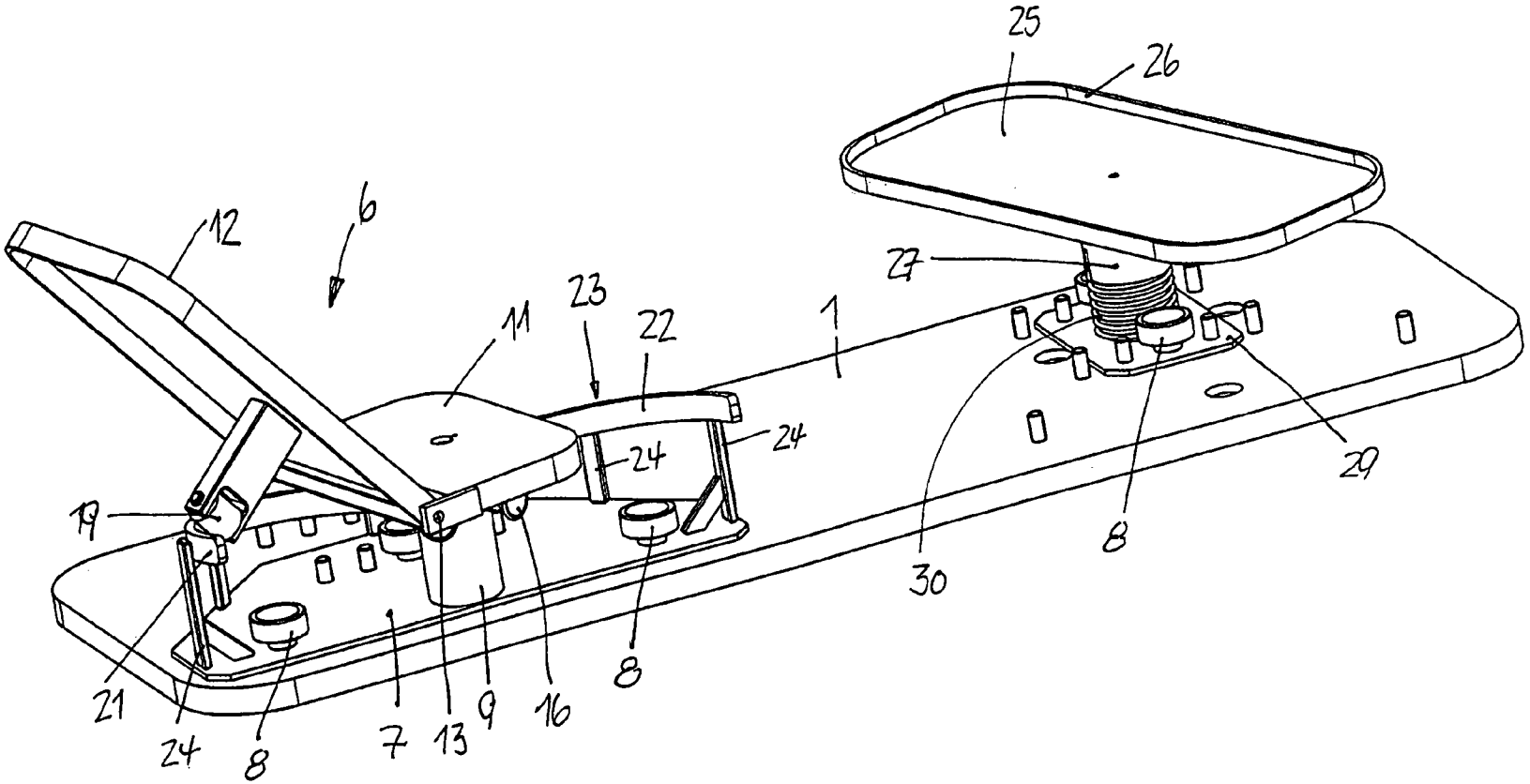
FIG. 3 shows a second oblique view of the device, with both supports pivoted out of their initial positions.
Figure 16:
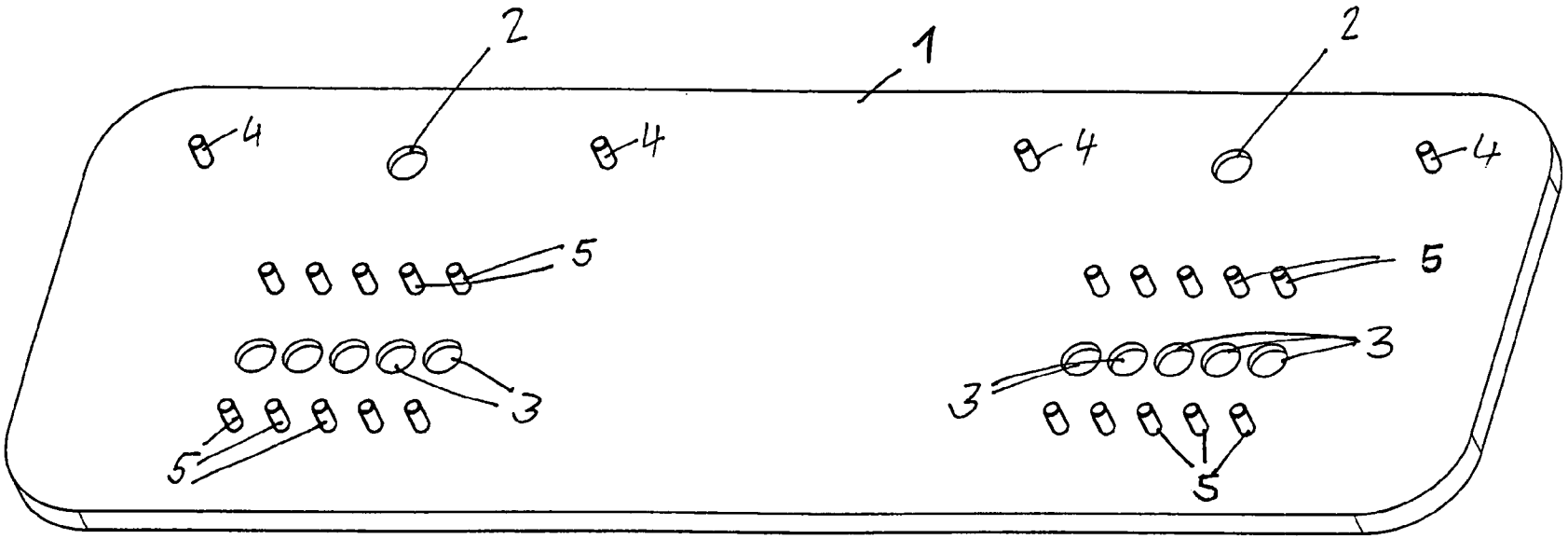
FIG. 16 shows an oblique view of the base of the device.

FIG. 1 shows an overall view of the device. It has a base 1 consisting of a flat plate with two separate bores 2, two rows of five bores 3 each, four separate pins 4 and four rows of five pins 5 each, provided in mirrored arrangement—see FIG. 16. The pins 4 and 5 are either solid and have an external thread, or are hollow in which case they have an internal thread.

A first support 6 is mounted on a first footplate 7 provided with two bores as passages for two pins 4 and five bores as passages for a row of five pins 5. A screw cap 8 is screwed onto each of the two pins 4 and the pins 5, for fixing the first footplate 7 on the base 1.

Above the bore 2 of the base 1, a sleeve 9 receiving a first—hollow—pin 10 is fixed on the first footplate 7. The pin 10 is mounted on the bottom of the first support 6, on a first supporting part 11 to which a second supporting part 12 is linked in a manner such that it can pivot about a horizontal axis 13.

The interaction of the first sleeve 9 and the first pin 10 will become clear from FIGS. 6 and 12 to 15: The first pin 10 comprises two slotted links 14 that extend approximately a quarter circle around the first pin 10, with oppositely directed slopes. The first sleeve 9 has two radial threaded bores 15 with a locking element 34 screwed into each bore, the latter being provided for that purpose with a base portion 35 with an external thread that can be screwed into the threaded bore 15. A bolt 17 seated in the base portion 35 projects from the base portion 35 in forward direction and can be withdrawn into the base portion 35 by a handle 16, against the action of a spring, and can be fixed in that retracted position by rotation of the handle 16. When the first pin 10 is introduced into the first sleeve 9, the bolt 17 can be advanced only when one of the two slotted links 14 is in alignment with the respective threaded bore 15.

Figure 6:
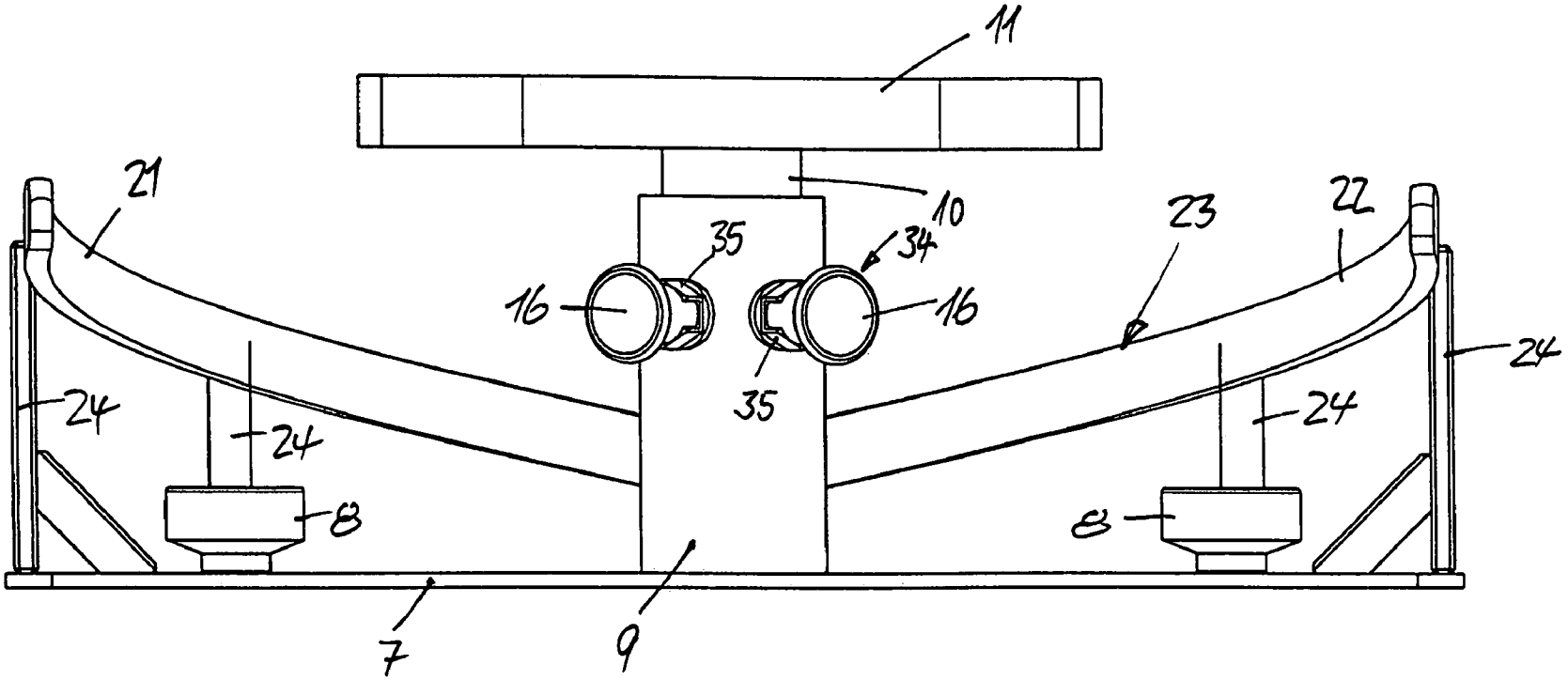
FIG. 6 shows an side view of the first support as a detail, in its initial position.
Figure 7:
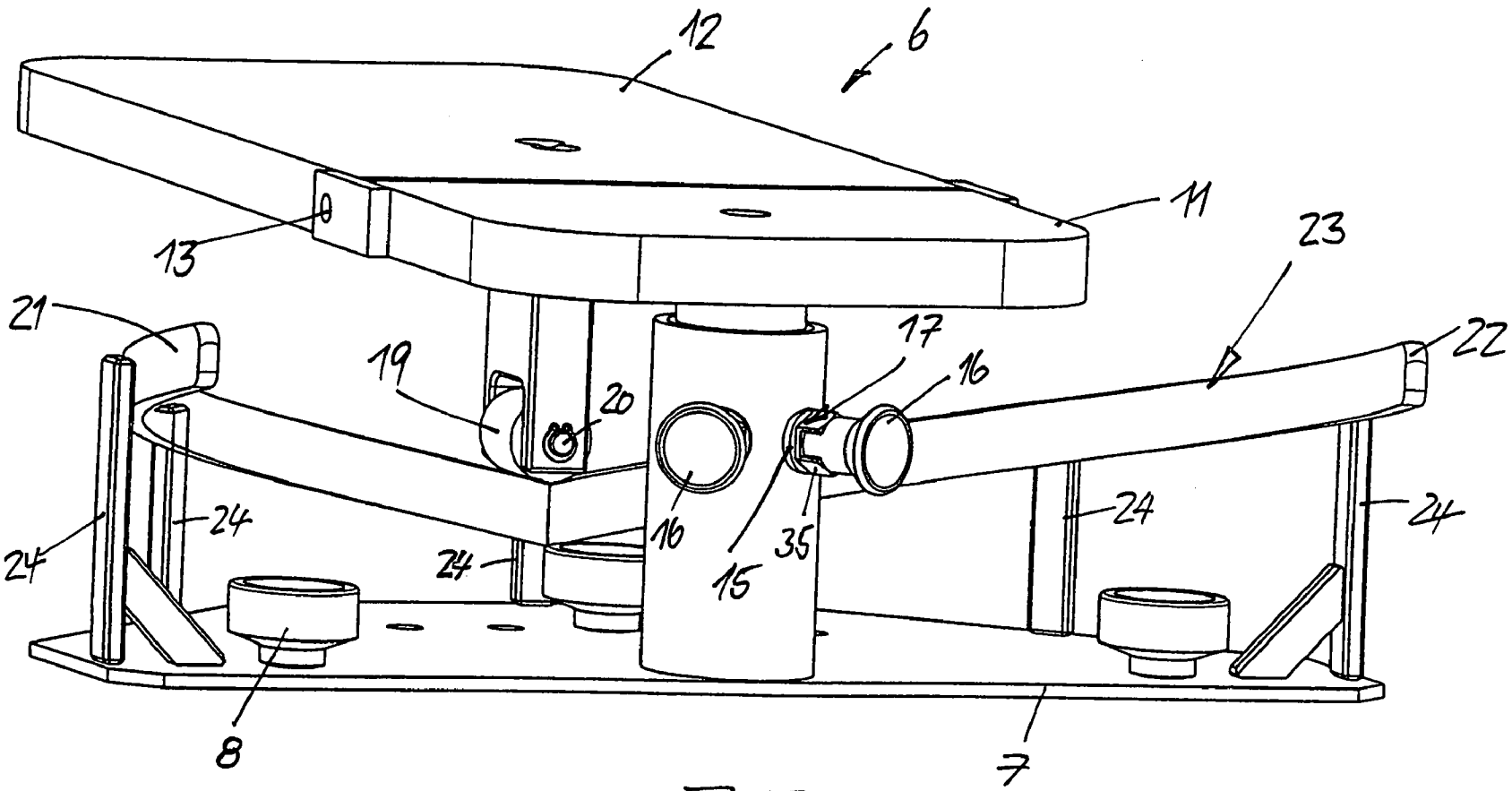
FIG. 7 shows an oblique view of the first support in its initial position.
Figure 8:
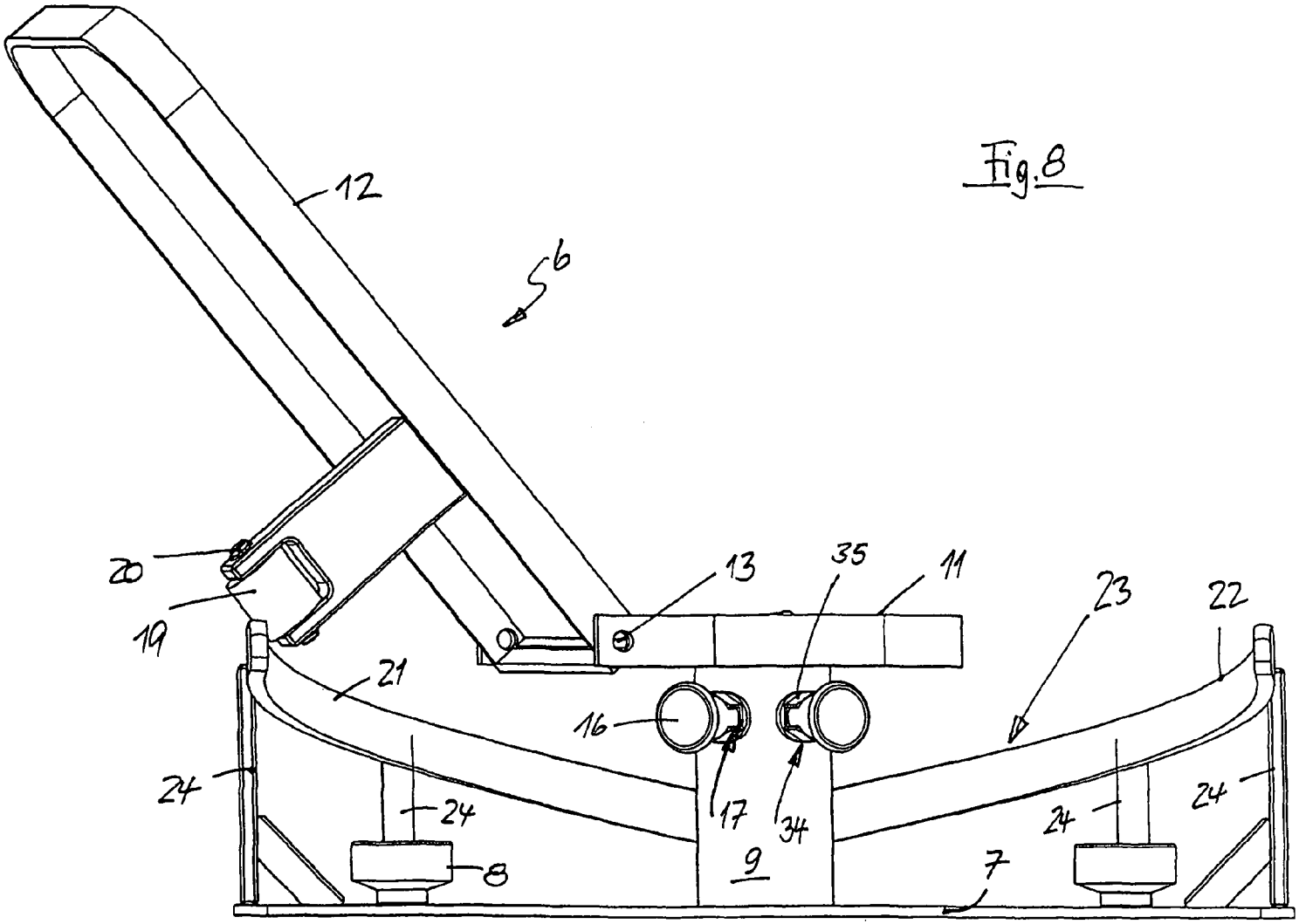
FIG. 8 shows a side view of the first support, similar to FIG. 6, but in a position swing out of its initial position.
Figure 9:
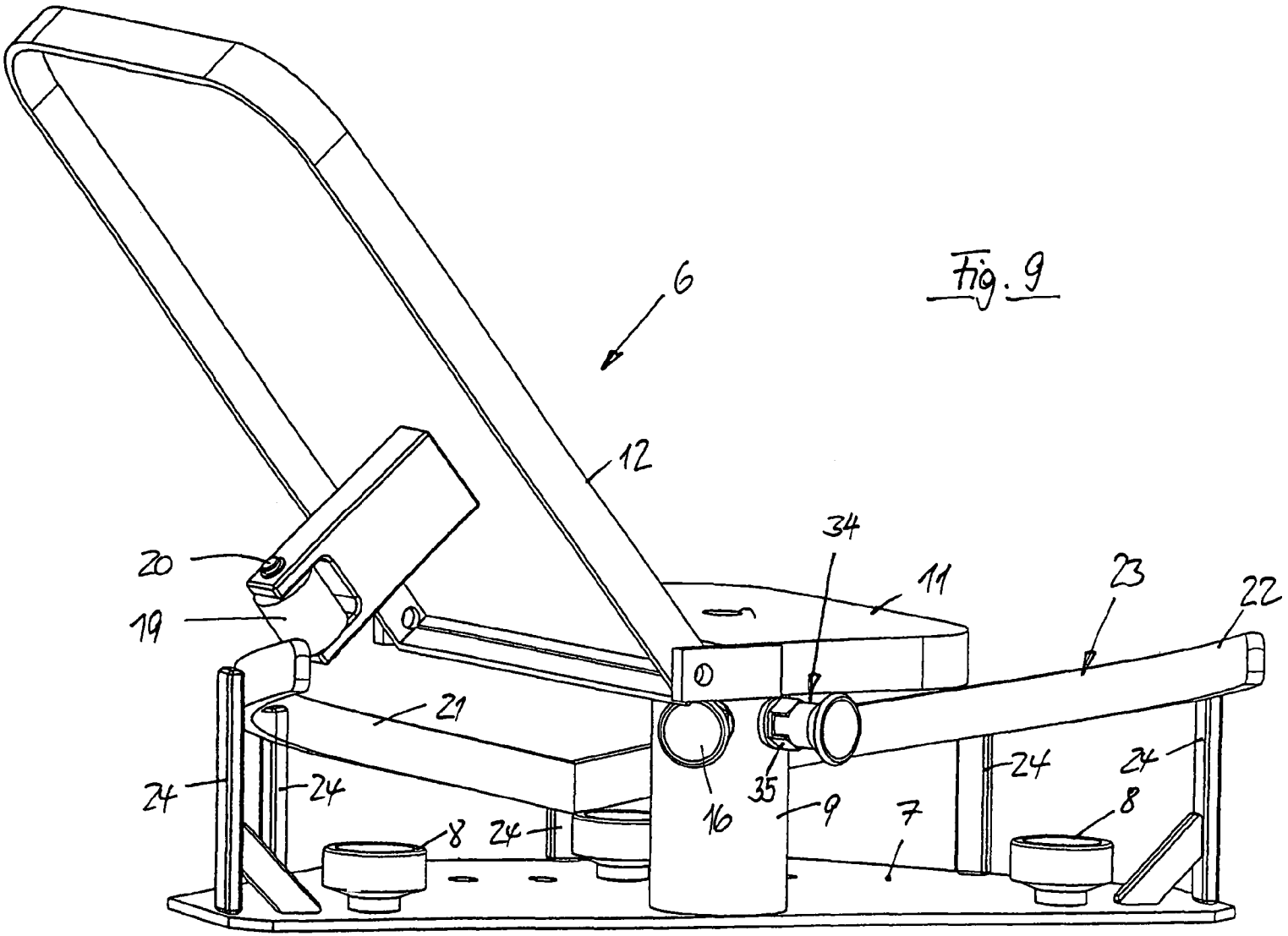
FIG. 9 shows an oblique view of the first support, similar to FIG. 7, but in a position swung out of its initial position.
Figure 10:
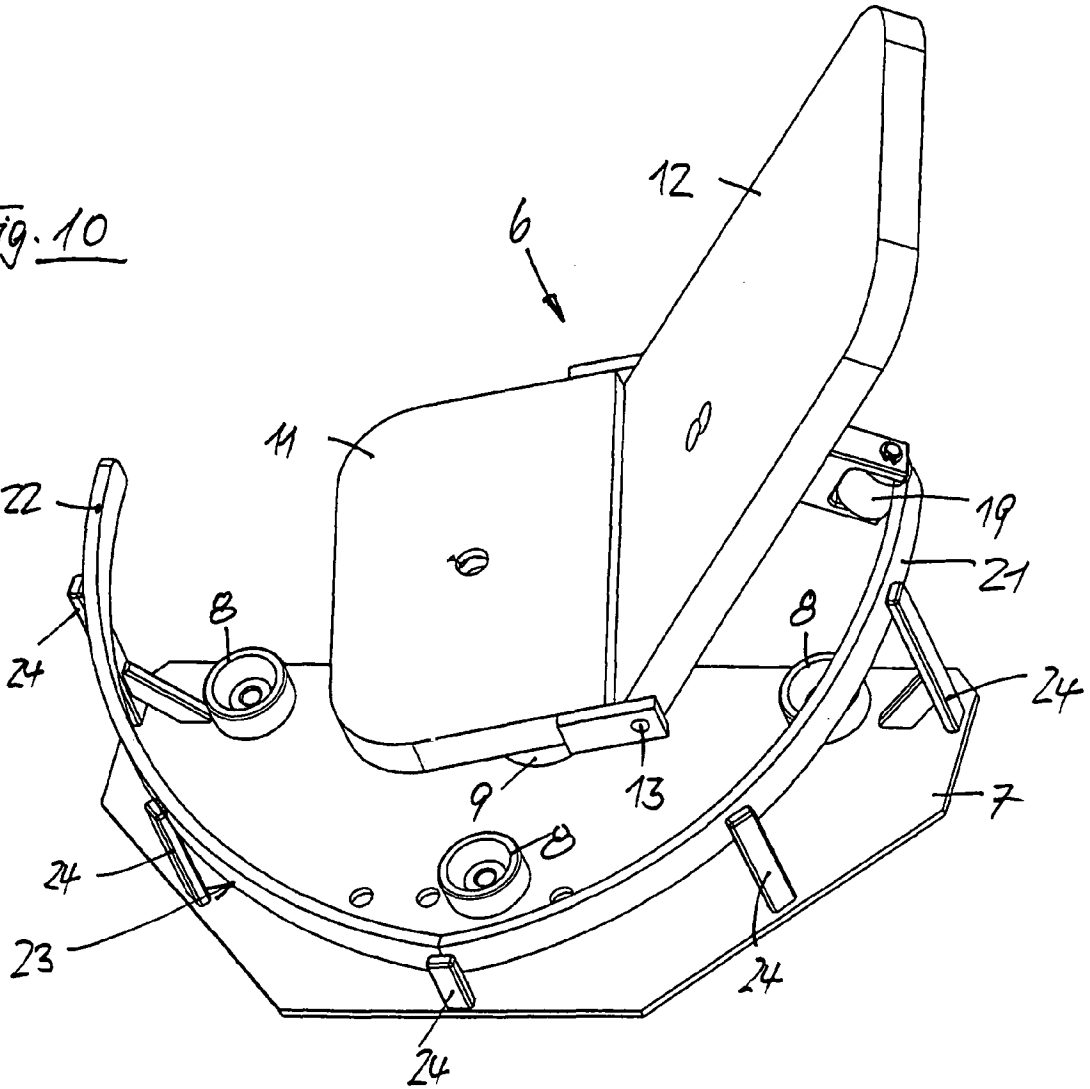
FIG. 10 shows an oblique view of the first support, swung out of its initial position, but viewed from a direction different from that of FIG. 9.
Figure 13:
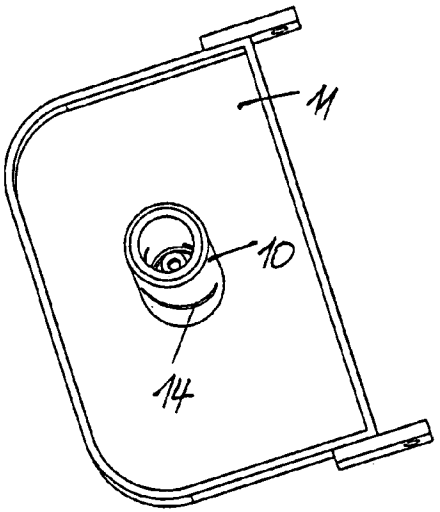
FIG. 13 shows a detail view, taken obliquely from below of a first supporting part of the first support, with a sleeve mounted on the bottom for receiving the hollow pin from FIG. 12.
Figure 11:
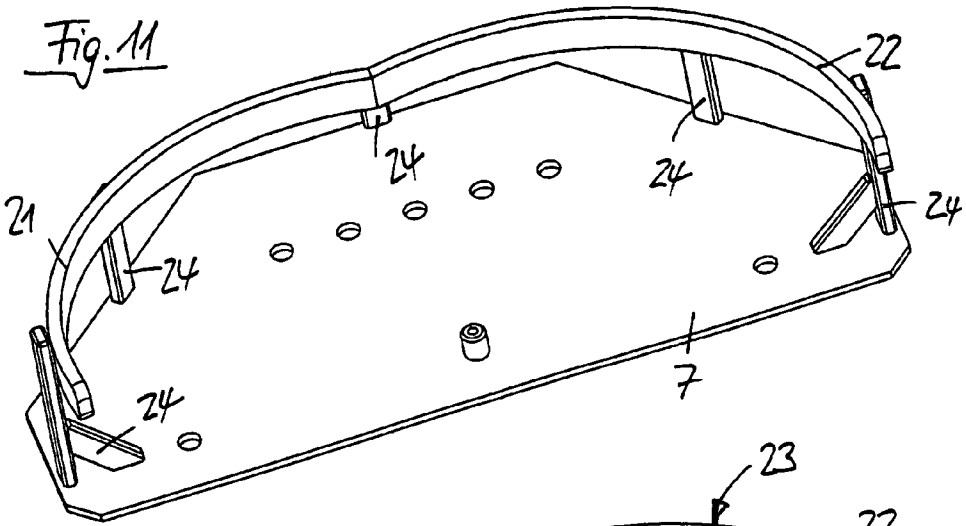
FIG. 11 shows an oblique view of the guide device as a detail, placed on a mounting plate.
Figure 12:
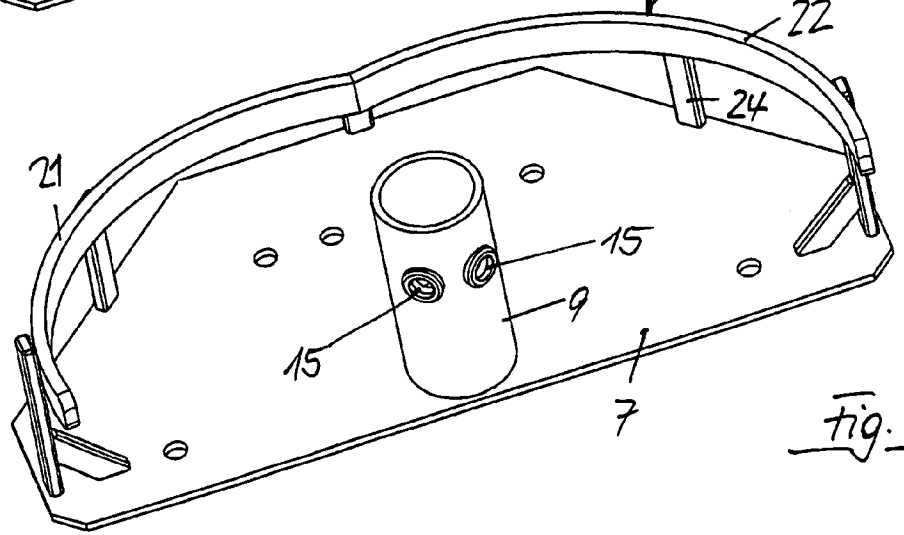
FIG. 12 shows a view similar to FIG. 11 of the guide device, supplemented by hollow pin, placed on the mounting plate.

The position of the two radial threaded bores 15 is adjusted to the position of the two slotted links 14 so that in one particular position—namely the initial position of the first support 6—each of the two slotted links 14 can be simultaneously engaged by a bolt 17. That position is shown in FIGS. 6 and 7. Due to the oppositely directed slope of the two slotted links 14, pivoting of the first support 6 is then not possible; the first support 6 is locked in its initial position. To allow the support to be pivoted, one of the two bolts 17 illustrated in FIGS. 6 and 7 must be withdrawn using the handle 16. Which one of the bolts 17 is to be withdrawn depends on whether the first support 6 is to be pivoted out of its initial position illustrated in FIGS. 6 and 7 toward the right or toward the left.

Figure 14:
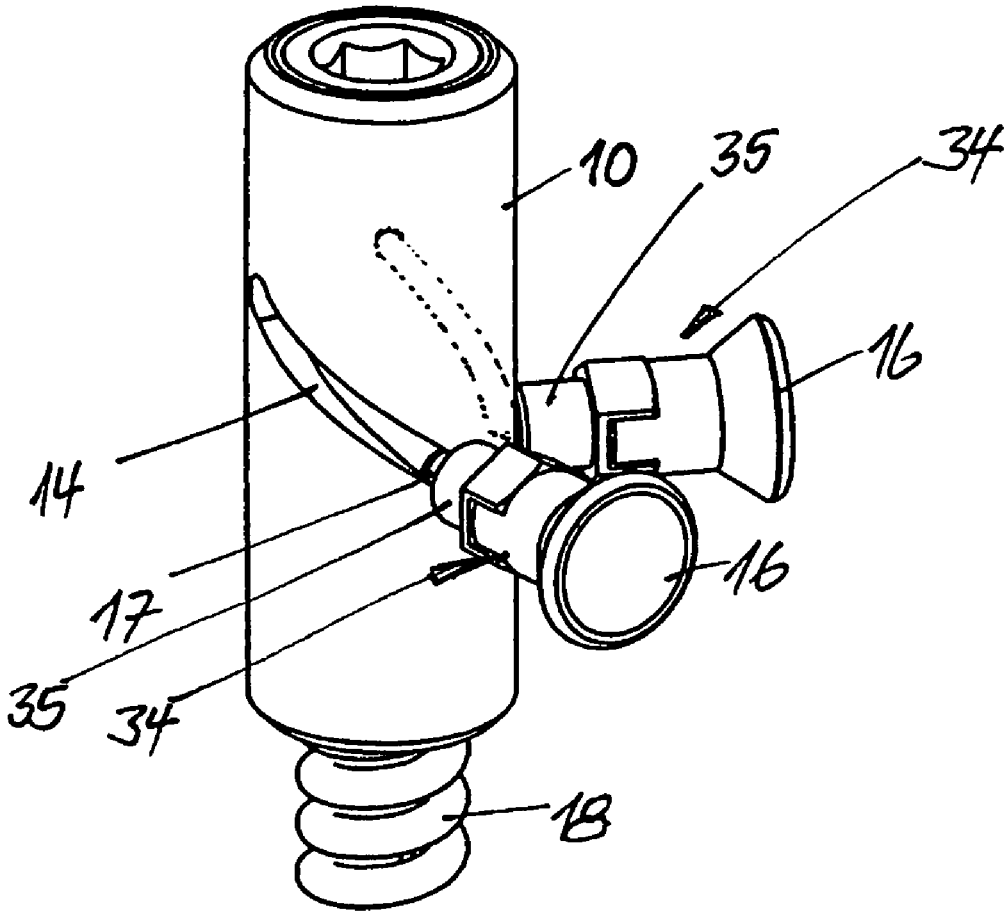
FIG. 14 shows an oblique detail view of the sleeve of FIG. 13 in combination with a helical spring and two plug-in bolts.
Figure 15:
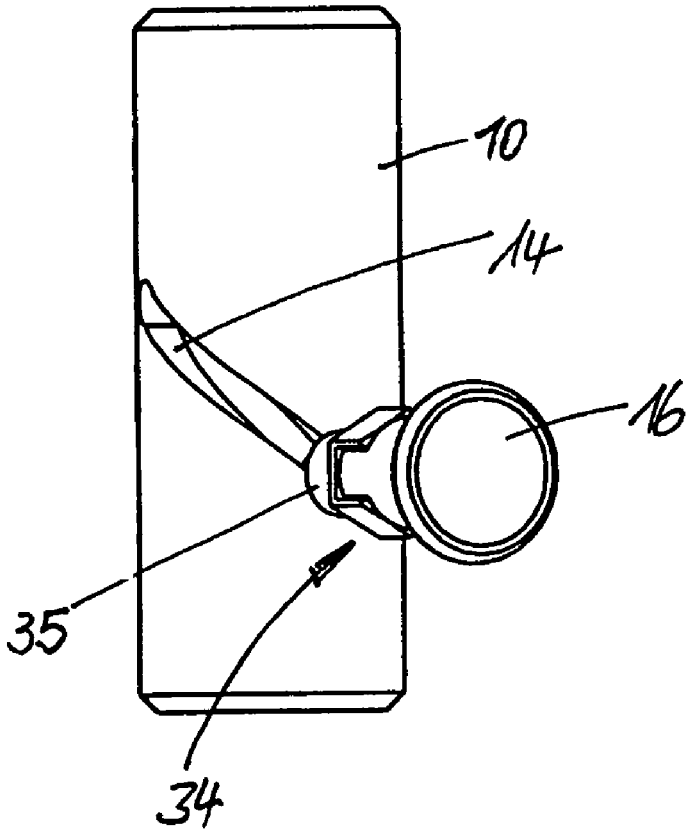
FIG. 15 shows a side view of the sleeve from FIG. 14.

FIG. 14 shows the first pin 16 with its one slotted link 14 with a fitted pin 17. The handle 16 for a second bolt 17 is also shown in FIG. 14 and indicates the position of the lower end of the second slotted link, not visible in FIG. 14, as it lies on the side of the first pin 10 turned away from the observer. The second handle 16, shown in a position at the lower end of the hidden slotted link, which rises from that point in a direction opposite to that of the visible slotted link 14, and with an oppositely directed slope.

FIG. 14 further shows that a pressure spring 18, designed as a helical spring, is fitted in the hollow first pin 10 and projects a certain length from the hollow pin 10 in downward direction. The pin 10, with the pressure spring ahead, is pushed into the first sleeve 9 and then still projects from the sleeve 9 a certain length, as illustrated in FIG. 6.

When the first support 6 is pivoted out of its initial position, after a bolt 17 has been retracted, the first pin 10 will screw down deeper into the first sleeve 9—due to the interaction of the remaining bolt 17 and the one slotted link 14—whereby the pressure spring 18 is compressed. When the first support 6 is released, the pressure spring 18 can relax and can push the first support 6 back into its initial position.

Mounted on the bottom of the second supporting part 12 is a free-wheeling roller 19 whose axis 20 extends in parallel to the top of the second supporting part 12 and vertically to a line parallel to the horizontal axis 13. The roller 19 runs on a curved guide rail 21 or 22, which is part of a guide device 23. The guide device 23 comprises the two curved guide rails 21 and 22 of mirror-inverted shape and brackets 24 for fixing the guide rails 21 and 22 on the first footplate 7. The two guide rails 21 and 22 are connected one with the other on one end and are commonly supported at that connection point by the shortest one of the brackets 24. From there, they extend in mirror-inverted shape around the first sleeve 9 over an angle of somewhat more than 90° each. Their distance from the first footplate 7 increases continuously up to their other free end. With the effect that when the first support 6 is swung out of its initial position (FIG. 1) the second supporting part 12 will be raised continuously as illustrated in FIGS. 2, 3, 8, 9 and 10. At the same time, the first supporting part moves a certain distance in downward direction toward the base 1, whereby the raising effect on the second supporting part 12 relative to the first supporting part 11 is further intensified.

Instead of supporting the guide rails 21 and 22 on brackets 24, it is also possible to provide an upright solid curved wall on the footplate 7 and to use the upper edge of the wall as a guide rail.

In addition to the first support 6, the base 1 further carries a second support 25, which contrary to the first support 6 shows an undivided design. It consists of a plate surrounded by an upright marginal strip 26. The marginal strip 26 protects the foot from sliding off the second support 25. A marginal strip may also be provided on the first supporting part 11 of the first support 6. The second supporting part 12 preferably does not have such a marginal strip.

Mounted on the bottom of the second support 25 is a second sleeve 27 that receives a second pin 28 mounted on a second footplate 29, the latter being fixed on the base 1. The second footplate 29 is provided for this purpose, on each side of the second pin 28, with one row of three bores intended to receive three of the five pins 5 (see FIG. 16). The second footplate 29 is secured on the base 1 by two crew caps 8. FIG. 1 shows the second footplate 29 arranged in the middle of a row of pins 5. By placing it farther to the left or to the right, the second support 25 can be placed closer to or farther remote from the first support 6 in order to adapt the arrangement to golfers of different standing widths.

Figure 4:
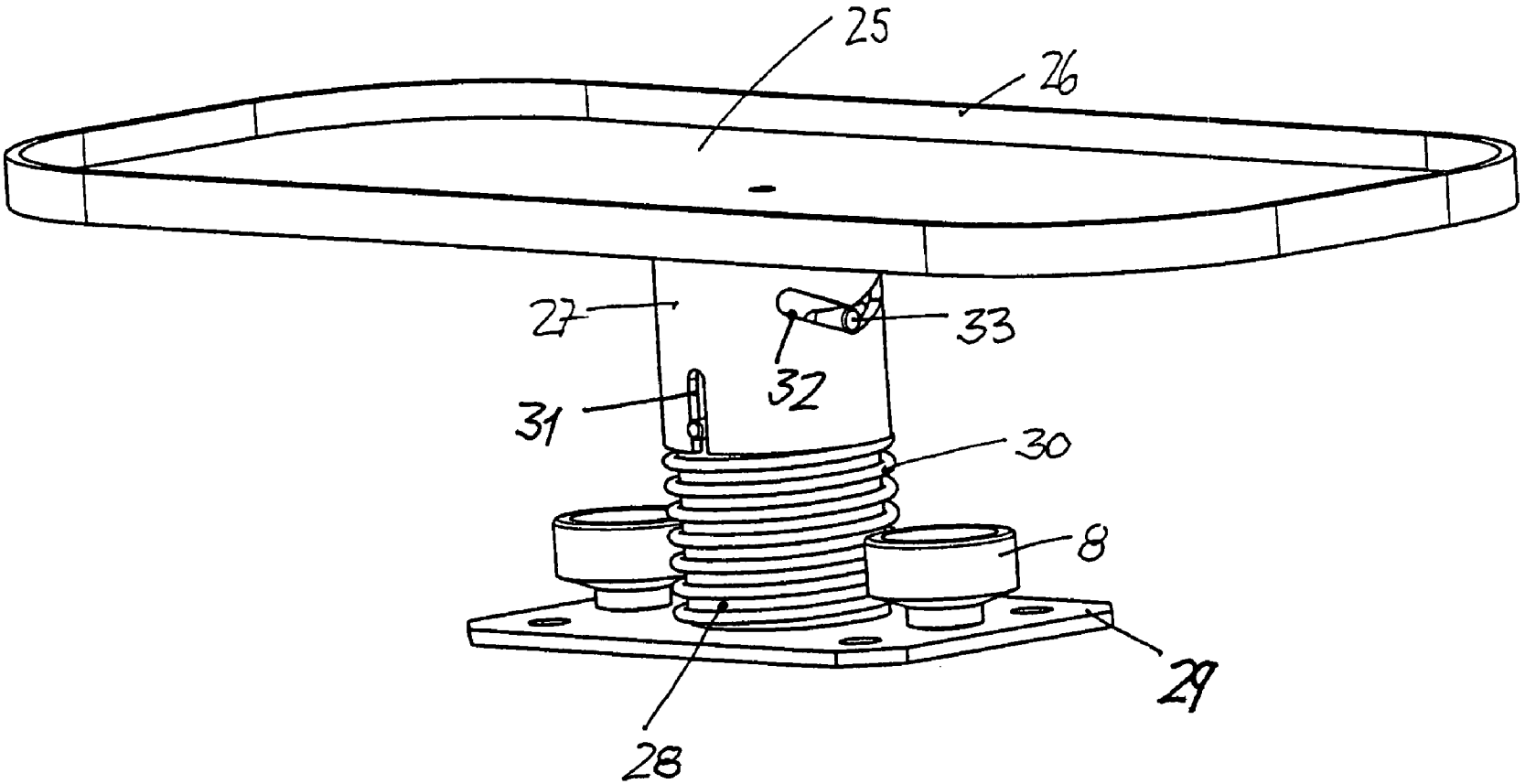
FIG. 4 shows an oblique view of the second support, as a detail, in its initial position.
Figure 5:
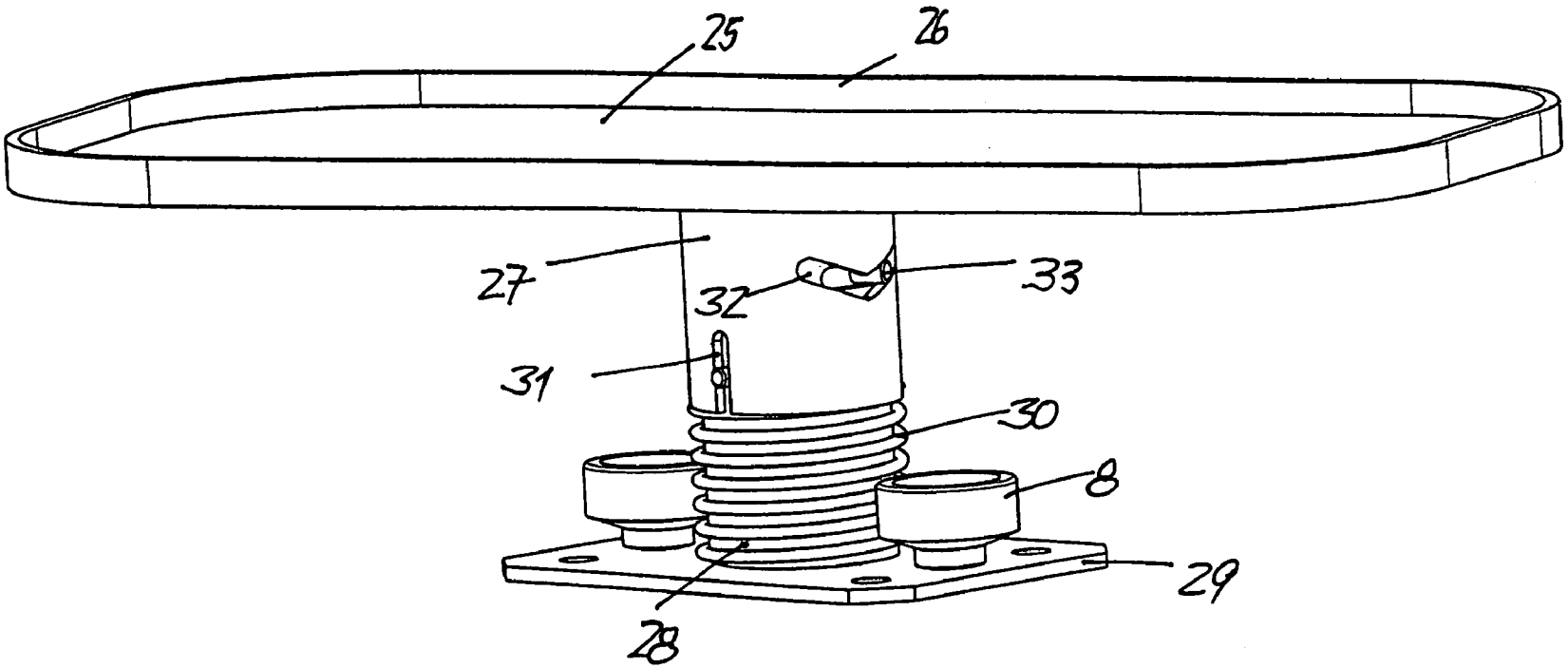
FIG. 5 shows an oblique view of a second support, similar to FIG. 4, but pivoted out of its initial position.

FIGS. 4 and 5 show in detail that a section of the second pin 28, not engaged in the second sleeve 27, is surrounded by a torsion spring 30 in the form of a helical spring, the upper end of which is received in the oblong slot 31 in the second sleeve 27 and the lower end of which—not shown in FIGS. 4 and 5—is fixed on the second footplate 29 or is fitted in a transverse bore in the second pin 28. When the second support 25 is swung out of its initial position illustrated in FIGS. 1 and 4, the torsion spring is tensioned whereby it produces a restoring moment.

As can be seen in FIGS. 4 and 5, the second sleeve 27 is provided with a second slotted link of V-shaped configuration, viewed from the side, the apex of the V defining the lowermost point of the slotted link 32. The slotted link is engaged by a second bold 33, fitted in a second pin 28 and extending in radial direction. The slope of the second slotted link 32 is less steep than the slope of the first slotted link 14. During a swinging movement, the second support 25 therefore moves down to a lesser degree than the first support 6. Further, the second slotted link 32 extends over a smaller circumferential angle than the first slotted link 14 so that the potential swinging angle, by which the second support 25 can be swung out of its initial position shown in FIGS. 1 and 4, is considerably smaller than the potential swinging angle of the support 6. As the two rising branches of the second slotted link 32 form together a continuous slotted link, the second support 25 may at any time be swung in either of the two possible swinging directions.

Alternatively, the second slotted link 32 may be given an exclusively horizontal design. This limits the swinging angle of the second support 25 which in that case is restricted to a horizontal movement.

The arrangement illustrated in FIG. 1 suited for use by a right-handed golfer. He places his left foot on the second support 25 and his right foot on the first support 6. To adjust the arrangement to a left-handed person, one would detach the two footplates 7 and 29 and fit the first footplate 7, in mirror-symmetrical position relative to the position illustrated in FIG. 1, on the left side of the base and the second footplate 29, in mirror-symmetrical arrangement relative to the position illustrated in FIG. 1, on the right side of the base 1. In order to prevent the pressure spring 18 from relaxing in an uncontrolled way and from causing injury during that process, the pressure spring preferably is secured for example by a screw which retains the spring and which engages the pressure spring 18 from the bottom of the hole 1, through the hole 2 in the base 1, so as to couple it with the base 1.

Alternatively, it is possible with particular advantage to omit the pins 5 provided in the area of the first footplate 6, to support the footplate 7 on the plate 1 for pivotal movement about the axis of the central screw cap 8, and to fix it by two outer screw caps 8 optionally in two positions rotated by 180° one relative to the other that can be transferred one into the other by rotation of the footplate 7 by 180° about the axis of its central screw cap 8. The second footplate 29 with the second support 25 can be fitted in a mirrored arrangement to complete the conversion of an arrangement for right-handed persons to an arrangement for left-handed persons.

Figure 17:
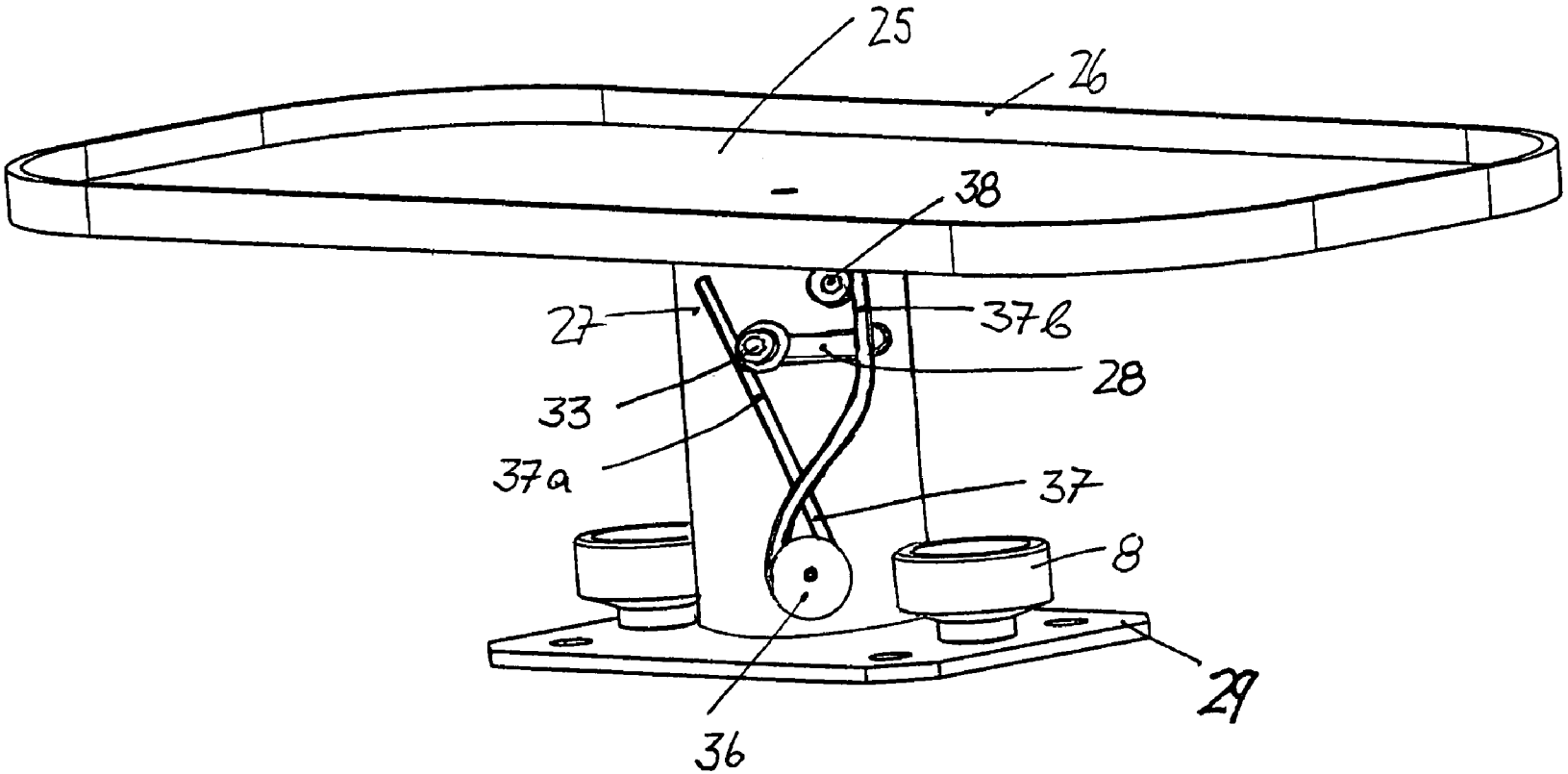
FIG. 17 shows a variation of the device in a representation similar to that of FIG. 4.

The variation of the device illustrated in FIG. 17 differs from the first embodiment in that the torsion spring 30 and the oblong slot 31 have been omitted. The sleeve 27 has been extended toward the bottom and the V-shaped slotted link 32 has been replaced by a horizontally extending slotted link 32. A retracting spring 37 is wound about a third bolt 36, arranged below the slotted link 32 and fitted in the second sleeve 27, with the legs 37*a* and 37*b* of the spring extending toward the second support 25 and crossing each other on that way. The one leg 37*a* of the retracting spring rests against the second bolt 33, while the other leg 37*b* rests against the fourth bolt 38, fitted in the second sleeve 27, tending to approach it again to the second bolt 33 when a golfer has pivoted the second support 25 and has tensioned the retracting spring 37 by performing the golf swing.

Figure 18:
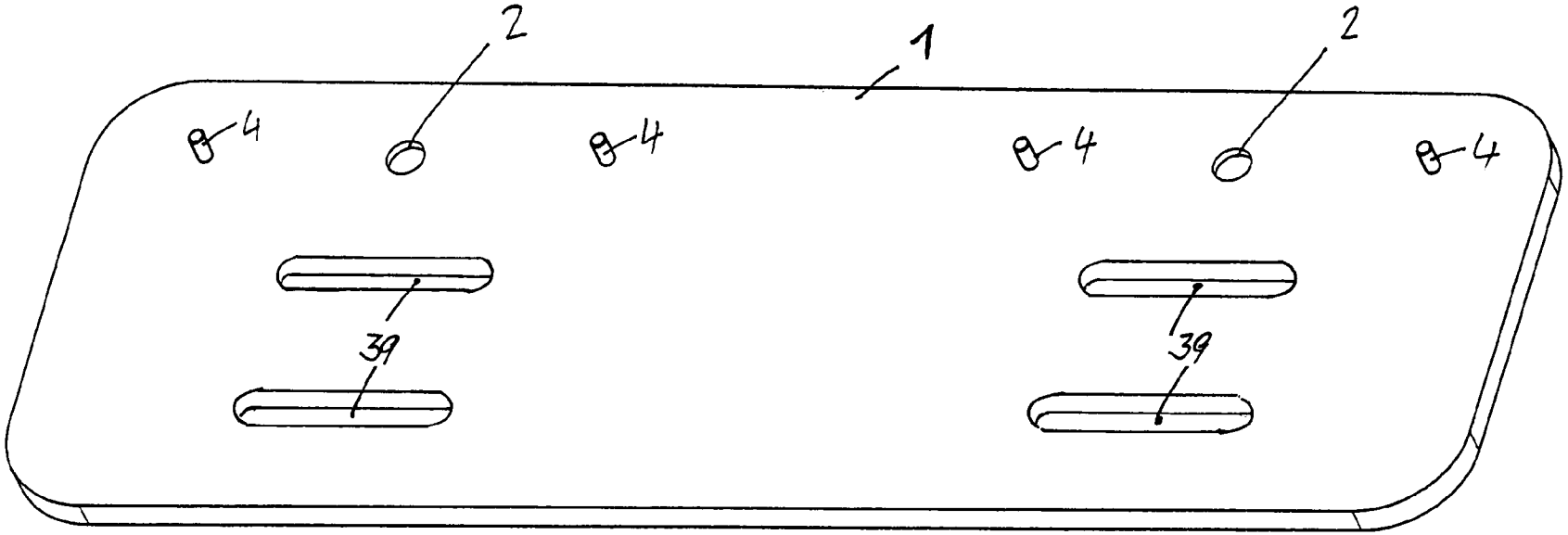
FIG. 18 shows a variation of the device in a representation similar to that of FIG. 16.

The variation of the device illustrated in FIG. 18 differs from the first embodiment in that the bore 3 and the pins 5 have been removed from the plate 1 and have been replaced by pairs of parallel oblong holes 39 by means of which the first footplate 7 and the second footplate 29 can be infinitely adjusted. Clamping screws 8 that engage the oblong holes 39 serve to clamp the footplates 7 and 29 in their respective positions.

LIST OF REFERENCE NUMERALS

1. Base, plate
2. Two separate bores
3. Two rows of bores
4. Four separate pins
5. Four rows of pins
6. First support
7. First footplate
8. Screw cap, clamping screw
9. First sleeve
10. First pin
11. First supporting part

12. Second supporting part
13. Horizontal axis
14. Slotted link in 10
15. Radial threaded bores
16. Handle
17. Bolt
18. Pressure spring
19. Roller
20. Axis of 19
21. Guide rail
22. Guide rail
23. Guide device
24. Braces
25. Second support
26. Marginal strip
27. Second sleeve
28. Second pin
29. Second footplate
30. Torsion spring
31. Oblong slot
32. Second slotted link
33. Second bolt
34. Locking means
35. Base portion
36. Third bolt
37. Retracting spring
37*a*. Leg of 37
37*b*. Leg of 37
38. Fourth bolt
39. Oblong holes

What is claimed is:

1. Device for practicing a sequence of movement in the golf swing, said device comprising:

a base (1), a first support (6), mounted on the base (1), for pivoting about a first vertical axis and sized for receiving a golf player's first foot, the first support (6) having a first supporting part (11) for supporting a front part of the first foot and a second supporting part (12), pivotable about a horizontal axis, for supporting a heel of the first foot, a guide device (23) arranged on the base (1) and at least partially surrounding the first vertical axis, the guide device having a curved design rising from a lowermost point and supporting the second supporting part (12) in order that during pivoting movement of the first support, the second supporting part (11), and supported heel, raises; and a second support (25) sized for receiving a golf player's second foot.

2. The device as defined in claim 1, wherein the second support (25) is separate from the base (1).

3. The device as defined in claim 2, wherein the second support (25) is mounted on the base (1) for pivoting about a second vertical axis.

4. The device as defined in claim 3, further comprising a second arrangement for pivotally mounting the second support (25), the a second arrangement comprising a second pin (28) and a second sleeve (27) accommodating the second pin (28), with either the second pin (28) or the second sleeve (27) being mounted on the base (1) and either the second sleeve (27) or the second pin (28) being mounted to the underside of the second support (25).

5. The device as defined in claim 4, further comprising a second slotted link (32), provided either in the second pin (28) or in the second sleeve (27) and engaged by a second bolt (33), provided in the second sleeve (27) or in the second pin (28), extends either along a horizontal line or has a slope such that the second support (25) moves in downward direction when the first support is swung out of its initial position.

6. The device as defined in claim 5, wherein the slope of the second slotted link (32) is 0.005 cm/degree up to 0.015 cm/degree of the pivot angle of the second support (25).

7. The device as defined in claim 6, wherein the slope of the second slotted link (32) is approximately 0.01 cm/degree of the pivot angle of the second support (25).

8. The device as defined in claim 5 wherein the second spring is a retracting spring (37) which is wound about a third bolt (36), fitted in the second sleeve (27), which substantially extends in radial direction and is arranged at a distance from the slotted link (32), below the latter, and comprises two legs (37*a*, 37*b*) one of such legs (37*a*) being pre-stressed against the second bolt (33) and the other leg (37*b*) being pre-stressed against the fourth bolt (38) fitted in the second sleeve (27) in substantially radial direction, the arrangement being such that the retracting spring (37) will be tensioned when the second support (25) is pivoted in the one direction, and will be relieved when it is pivoted in the other direction when the second support (25) is retracted to its initial orientation.

9. The device as defined in claim 8, wherein the legs (37*a*, 37*b*) of the retracting spring (37) cross each other.

10. The device as defined in claim 8 wherein the base (1) has holders (2-5) for the two supports (6, 26) arranged at different spacings.

11. The device as defined in claim 10, wherein the holders (2-5) are bores (2,3) and/or pins (4,5) arranged in the base (1).

12. The device as defined in claim 1 wherein the supports (6, 25) have initial orientations with respect to the base (1).

13. The device as defined in claim 12 wherein the supports (6, 25) enclose between them an angle of between 0° and 30° in the initial orientations.

14. The device as defined in claim 12 further comprising a first spring (18) for biasing the first support (6) to the first support (6) initial orientation.

15. The device as defined in claim 14 wherein for pivotally mounting the first support (6) there is provided a first arrangement, consisting of a first pin (10) and a first sleeve (9), accommodating the first pin (10), with either the first pin (10) or the first sleeve (9) being mounted on the base (1) and either the first sleeve (9) or the first pin (10) being mounted on the bottom of the first support (6).

16. The device as defined in claim 15, further comprises a slotted link (14) provided either in the first pin (10) or in the first sleeve (9) and engaged by a bolt (17) provided in the first sleeve (9) or in the first pin (10) has a slope which is selected to cause the first supporting part (11) of the first support (6) to move in downward direction when the first support is swung out of its first support initial orientation.

17. The device as defined in claim 16 wherein a slope of the first slotted link (14) is 0.01 cm/degree up to 0.025 cm/degree of the pivot angle of the first support (6).

18. The device as defined in claim 17, wherein the slope of the first slotted link (14) is approximately 0.02 cm/degree of the pivot angle of the first support (6).

19. The device as defined in claim 16 wherein two slotted links (14), with slopes rising in opposite directions, are associated to the first support (6) and that the bolt (17) engages either the one slotted link (14) or the other slotted link for determining the swinging direction of the first support (6).

20. The device as defined in claim 15 further comprising a pressure spring (18) arranged in the first sleeve (9), the pressure spray (18) being continuously compressed when the first support (6) is swung out of the spring (18) first support initial orientation as the first pin (10) moves progressively deeper into the first sleeve (9).

21. The device as defined in claim 20, wherein the first pin (10) is hollow and the pressure spring (18) extends into the hollow space of the first pin (10).

22. The device as defined in claim 20 wherein the pressure spring (18) is a helical spring or a stack of cup springs.

23. The device as defined in claim 14 further comprising a second spring (30, 37) for biasing the second support (25) to the second support initial orientation.

24. The device as defined in claim 23, wherein the second spring (30) is a torsion spring surrounding the second axis.

25. The device as defined in claim 23 wherein the second spring (30) is a helical spring.

26. The device as defined in claim 1 wherein the base (1) has holders (2-5) at least for the first support (6) and for the guide device (23) coacting with it, the configuration and arrangement of the holders being such that the arrangement of the two supports (6, 25) and of the guide device (23) can be varied to obtain a mirrored arrangement.

27. The device as defined in claim 1 wherein the guide device (23), starting from its lowermost point, describes a rising curve both in clockwise direction and in counter-clockwise direction.

28. The device as defined in claim 1 wherein the base (1) comprises a horizontal plate on which the two supports (6, 25) and the guide device (23) are mounted.

29. The device as defined in claim 28, wherein the plate (1) has at least one pair of parallel oblong holes (39) in which the first support (6) and/or the second support (25) can be fixed to change their mutual spacing.

30. The device as defined in claim 1 wherein the second supporting part (12) is hinged to the first supporting part (11).

31. The device as defined in claim 1 further comprising a roller (19), rolling on the guide device (23), is mounted on the first support (6), especially on its second supporting part (11).

32. The device as defined in claim 1 further comprising a tee-off surface for supporting a golf ball in a tee-off position.

33. The device as defined in claim 1 further comprising a holder for holding a tee in a tee-off position.

34. The device as defined in claim 1 wherein the first vertical axis is arranged below the first supporting part (11) of the first support (6).

* * * * *